US009570054B2

(12) United States Patent
Abe et al.

(10) Patent No.: US 9,570,054 B2
(45) Date of Patent: Feb. 14, 2017

(54) MUSICAL BAR FOR MUSICAL INSTRUMENT

(71) Applicant: Yamaha Corporation, Hamamatsu-shi, Shizuoka-ken (JP)

(72) Inventors: Banri Abe, Hamamatsu (JP); Kiminori Inoue, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 15/049,355

(22) Filed: Feb. 22, 2016

(65) Prior Publication Data

US 2016/0247493 A1 Aug. 25, 2016

(30) Foreign Application Priority Data

Feb. 23, 2015 (JP) ..... 2015-033094

(51) Int. Cl.
*G10D 13/08* (2006.01)
*G10K 1/10* (2006.01)

(52) U.S. Cl.
CPC ..... *G10D 13/08* (2013.01); *G10K 1/10* (2013.01)

(58) Field of Classification Search
CPC ..... G10D 13/08
See application file for complete search history.

(56) References Cited

U.S. PATENT DOCUMENTS 1,210,950 A * 1/1917 Kohler ..... G10D 13/08 340/392.5
1,291,778 A * 1/1919 Deagan ..... G10D 13/08 84/403
1,708,495 A * 4/1929 Claiborne ..... G10D 13/08 84/403
3,731,580 A * 5/1973 Suzuki ..... G10D 13/08 84/403
4,649,791 A 3/1987 Sawada et al.
5,686,679 A * 11/1997 Nakano ..... G10D 13/08 84/402

(Continued)

FOREIGN PATENT DOCUMENTS

JP 26-4236 5/1951
JP 49-61521 5/1974

(Continued)

OTHER PUBLICATIONS

European Search Report issued in counterpart European Application No. 16155089.2 dated Jul. 11, 2016 (seven pages).

(Continued)

*Primary Examiner* — Robert W Horn
(74) *Attorney, Agent, or Firm* — Crowell & Moring LLP

(57) ABSTRACT

A musical bar for a musical instrument includes a striking surface and a back surface which is a back side of the musical bar from the striking surface. When the striking surface is struck, the musical bar is vibrated to produce a musical tone with a unique pitch as a pitch of a fundamental tone. A recess is formed in the musical bar so as to be recessed from the back surface toward the striking surface. A position of a node of vibration of the fundamental tone for the musical bar is substantially aligned with an imaginary center of gravity of the recess in a longitudinal direction of the musical bar.

5 Claims, 4 Drawing Sheets

(56) References Cited

U.S. PATENT DOCUMENTS

| | | | | |
|---|---|---|---|---|
| 6,245,978 | B1 * | 6/2001 | Stevens | G10D 13/08 84/402 |
| 8,049,089 | B2 * | 11/2011 | Stevens | G10D 13/08 84/402 |
| 2016/0247493 | A1 * | 8/2016 | Abe | G10K 1/10 |

FOREIGN PATENT DOCUMENTS

| | | | |
|---|---|---|---|
| JP | 52-94827 | | 7/1977 |
| JP | 8-202351 | A | 8/1996 |
| JP | 8-254976 | A | 10/1996 |
| JP | 2570511 | B2 | 1/1997 |
| JP | 2007-163782 | A | 6/2007 |
| JP | 2007-163784 | A | 6/2007 |

OTHER PUBLICATIONS

Japanese-language Office Action issued in counterpart Japanese Application No. 2015-033094 dated Dec. 6, 2016 with English translation (Five (5) pages).

* cited by examiner

MUSICAL BAR FOR MUSICAL INSTRUMENT

CROSS REFERENCE TO RELATED APPLICATION

The present application claims priority from Japanese Patent Application No. 2015-033094, which was filed on Feb. 23, 2015, the disclosure of which is herein incorporated by reference in its entirety.

BACKGROUND

Technical Field

The following disclosure relates to a musical bar for a musical instrument which is vibrated, when a striking surface of the musical bar is struck, to produce a musical tone with its unique pitch.

Description of the Related Art

There are known conventional musical bars for musical instruments such as marimbas. When a front striking surface of the musical bar is struck, the musical bar is vibrated to produce a musical tone with its unique pitch. The musical bar is in most cases supported by the musical instrument so as to efficiently produce a pitch of a fundamental tone.

For example, Patent Document 1 (Japanese Patent Application Publication No. 2007-163782) and Patent Document 2 (Japanese Patent Application Publication No. 2007-163784) disclose musical bars constructed such that the musical bar has a support hole extending substantially in a widthwise direction of the musical bar, and the support hole is formed at a position of a node of vibration of the musical bar at which there is no motion during the vibration. The musical bar is supported by the musical instrument via a connecting string inserted in the support hole. Patent Document 3 (Japanese Patent No. 2570511) discloses a musical bar having a through hole near a node of vibration of the musical bar. The through hole is formed through the musical bar in its thickness direction. The diameter of the through hole is larger than that of a pin which is provided in a base so as to extend through the through hole. The pin restricts horizontal movement of the musical bar. The musical bar is vibrated on a string near the through hole.

SUMMARY

Incidentally, the musical bar is conventionally tuned by adjusting the entire length of the musical bar and adjusting an amount of cutting for forming a recess in a back portion of the musical bar, for example. In general, the longer the entire length, the lower the pitch is. Also, the larger the amount of cutting for the recess, the lower the pitch is. Adjustment of overtones, especially amplitudes of the overtones, is also important in tuning for adjusting tone color. Changes in amount of cutting for the recess can raise and lower frequencies of the overtones but cannot change the amplitudes of the overtones. The amplitudes of the overtones can be changed by changing the material, dimensions, and/or shape of the musical bar, but it is difficult to obtain desired amplitudes. Thus, it is difficult to adjust tone color while adjusting pitches.

Accordingly, an aspect of the disclosure relates to a musical bar for a musical instrument which enables easy adjustment of tone color without greatly affecting a unique pitch.

In one aspect of the disclosure, a musical bar for a musical instrument includes: a striking surface; and a back surface which is a back side of the musical bar from the striking surface. When the striking surface is struck, the musical bar is vibrated to produce a musical tone with a unique pitch as a pitch of a fundamental tone. A recess is formed in the musical bar so as to be recessed from the back surface toward the striking surface. A position of a node of vibration of the fundamental tone for the musical bar is substantially aligned with an imaginary center of gravity of the recess in a longitudinal direction of the musical bar.

In another aspect of the disclosure, a musical bar for a musical instrument includes: a striking surface; and a back surface which is a back side of the musical bar from the striking surface. When the striking surface is struck, the musical bar is vibrated to produce a musical tone with a unique pitch as a pitch of a fundamental tone. An insertion hole is formed in the musical bar so as to extend substantially in a widthwise direction thereof, and a supporter via which the musical bar is supported by the musical instrument is inserted in the insertion hole. In addition to the insertion hole, a recess is formed, in the longitudinal direction, in an area including a node of vibration of the fundamental tone.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Hereinafter, there will be described one embodiment by reference to the drawings.

Figure 1:
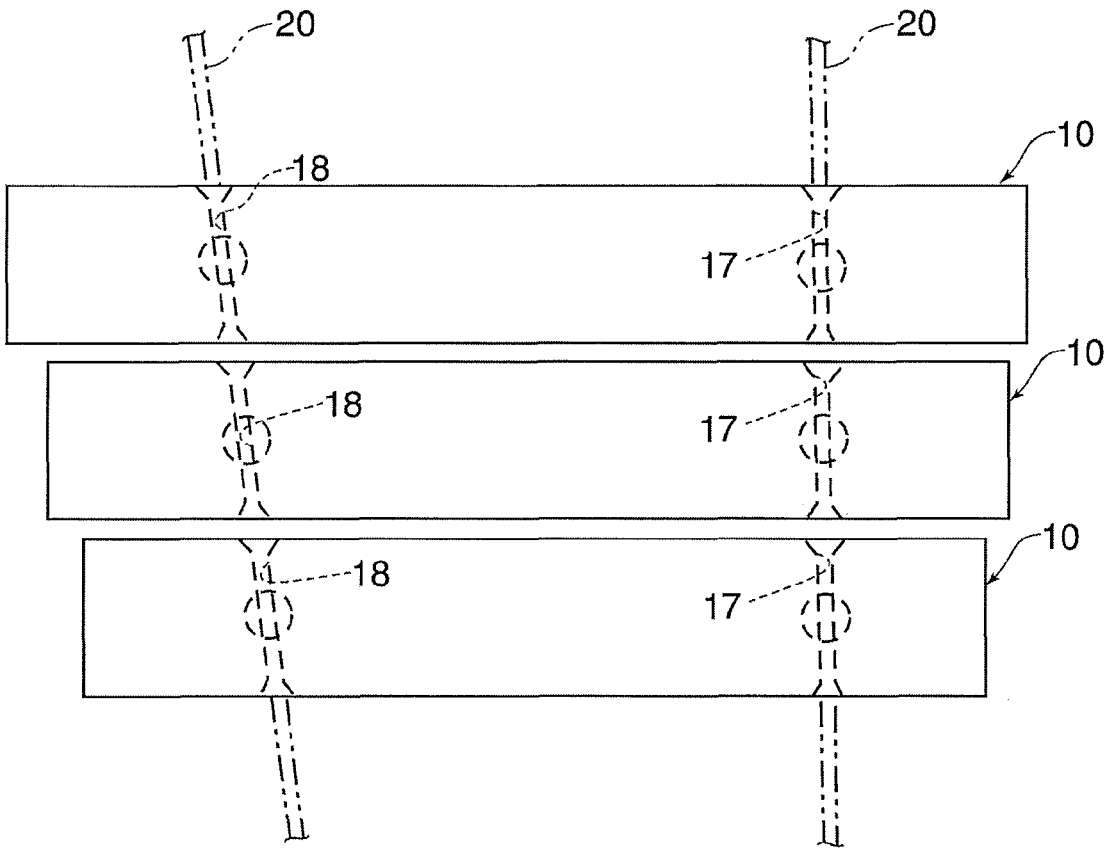
FIG. 1 is a plan view illustrating a portion of a musical instrument including musical bars according to one embodiment.

FIG. 1 is a plan view illustrating a portion of a musical instrument including musical bars 10 according to one embodiment. Examples of the musical instrument include xylophones, marimbas, vibraphones, and glockenspiels. The musical bars 10 may be employed for keyboard instruments such as celestas. FIG. 1 illustrates three musical bars 10 arranged next to each other. The musical bars 10 are supported on the musical instrument by connecting strings 20 each as a supporter. The musical bars 10 respectively produce tones with their respective unique pitches. The different musical bars 10 have different shapes, such as the entire length, in accordance with the pitches. However, the musical bars 10 have the same fundamental construction, and the construction of one of the musical bars 10 will be described with reference to FIGS. 2A-2F by way of example.

Figure 2A:
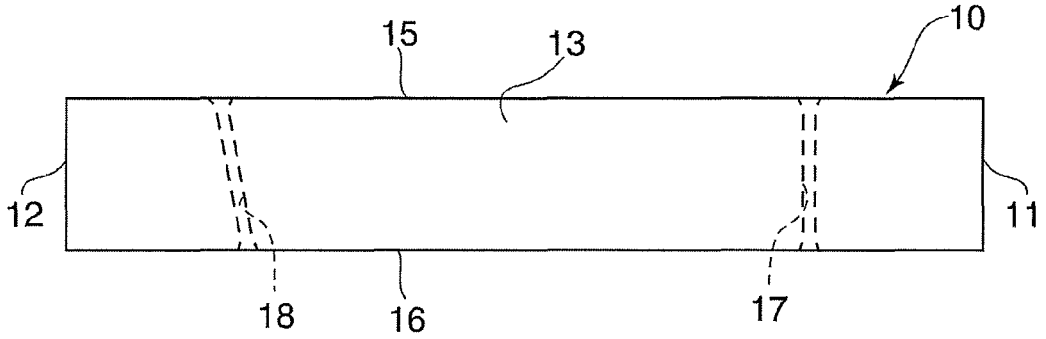
FIG. 2A is a plan view of one of the musical bars.
Figure 2B:
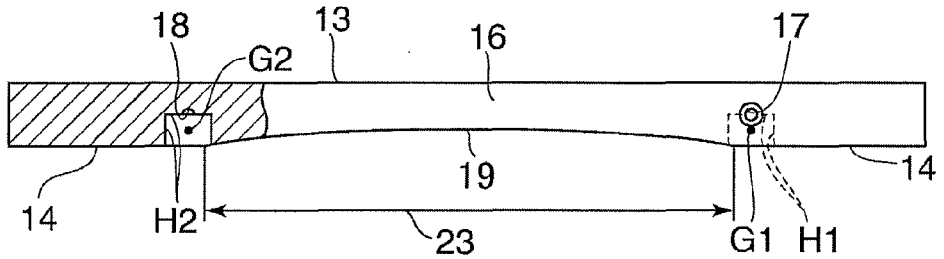
FIG. 2B is a side view of the musical bar.
Figure 2C:
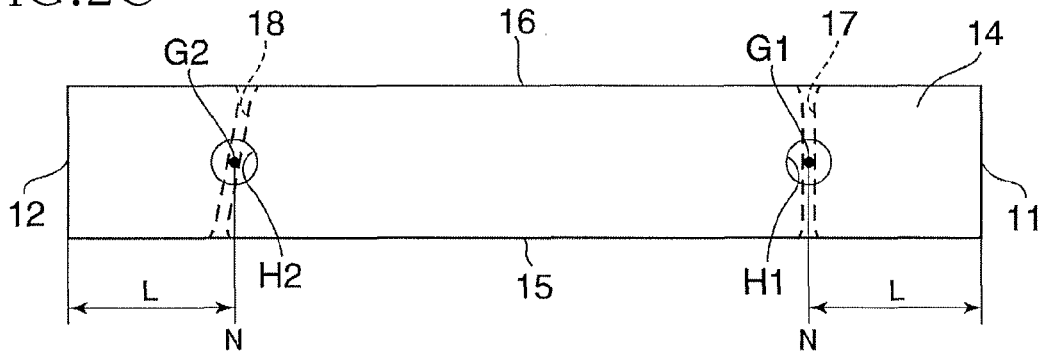
FIG. 2C is a bottom view of the musical bar.

FIGS. 2A, 2B, and 2C are plan, side, and bottom views of the one musical bar 10, respectively. A portion of the musical bar 10 is illustrated in cross section in FIG. 2B. The musical bar 10 having a substantially planar plate shape extends from one end 11 to the other end 12 in its longitudinal direction. That is, the entire length of the musical bar 10 is equal to a distance between the one end 11 to the other end 12. A front one of opposite surfaces of the musical bar 10 in its thickness direction is a flat striking surface 13, and the other surface is a back surface 14. Opposite surfaces of the musical bar 10 in its widthwise direction are a flat first side surface 15 and a flat second side surface 16. The musical bar 10 is provided in the musical instrument, with the first side surface 15 located on a lower-pitch side. In some musical instruments, the musical bar 10 is provided, with its lower surface serving as the striking surface 13.

The musical bar 10 has insertion holes 17, 18 spaced apart from each other substantially in the widthwise direction. Each of the insertion holes 17, 18 extends through the musical bar 10 from the first side surface 15 to the second side surface 16. The insertion hole 17 extends in a direction substantially perpendicular to the first side surface 15 and the second side surface 16, but the insertion hole 18 is inclined so as to be nearer to the other end 12 at a portion of the insertion hole 18 which is near the first side surface 15 than at a portion of the insertion hole 18 which is far from the first side surface 15. As illustrated in FIG. 1, the musical bar 10 with a lower unique pitch is disposed to the left of the musical bar 10 with a higher unique pitch and is longer in entire length than the musical bar 10 with a higher unique pitch. Thus, the distance between the insertion hole 17 and the insertion hole 18 is greater in the musical bar 10 with a lower unique pitch than in the musical bar 10 with a higher unique pitch. When the musical bars 10 are arranged in the musical instrument in order of pitch, the insertion holes 17 of the respective musical bars 10 are concentric with each other, and likewise the insertion holes 18 of the respective musical bars 10 are concentric with each other. One of the connecting strings 20 is drawn through the insertion holes 17, and the other through the insertion holes 18.

As illustrated in FIGS. 2B and 2C, the insertion holes 17, 18 are respectively formed at nodes N in a first vibrating mode. The musical bar 10 efficiently produces tones when vibrated in a state in which the musical bar 10 is supported at the insertion holes 17, 18. Each of the nodes N is a point at which there is no motion in the first vibrating mode, and the amplitude is equal to zero. The musical bar 10 has an area 23 at its central portion in the longitudinal direction. The musical bar 10 at the area 23 is gently recessed so as to form a belly portion 19 which has the thickness less than that of the other portion of the musical bar 10. At a center of the belly portion 19, the amplitude and displacement are greatest in the first vibrating mode.

The center of each of the insertion holes 17, 18 in its axial direction is spaced apart from a corresponding one of the one end 11 and the other end 12 at a distance L in the longitudinal direction of the musical bar 10 and substantially aligned with a corresponding one of the nodes N. The distance L is 22.4% of the entire length of the musical bar 10.

Two recesses H are formed in the back surface 14 of the musical bar 10 so as to be recessed toward the striking surface 13. One of the recesses H is a recess H1 located near the one end 11, and the other recess is a recess H2 located near the other end 12. The recesses H1, H2 have the same shape, and each of the recesses H1, H2 will be referred to as "recess H" in the case where these recesses need not be distinguished. In the present embodiment, each recess H is a blind hole having a substantially flat bottom and having a round shape in cross section taken along a direction perpendicular to the thickness direction of the musical bar 10. The recess H is what is called a countersunk hole. The recess H extends toward the striking surface 13 so as to communicate with a corresponding one of the insertion holes 17, 18. In the case of an imaginary object having the same shape as that of the recess H, the object has a substantially circular cylindrical shape.

Figure 2D:
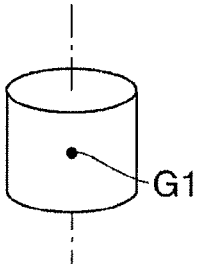
FIG. 2D is a perspective view of an imaginary object having the same shape as that of a recess.
Figure 2E:
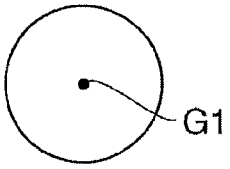
FIG. 2E is a bottom view of the imaginary object.
Figure 2F:
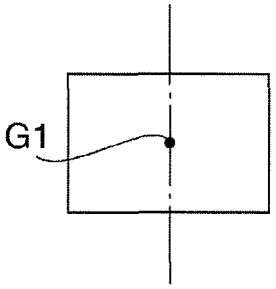
FIG. 2F is a side view of the imaginary object.

FIGS. 2D, 2E, and 2F are respectively plan, bottom, and side views of an imaginary object having the same shape as that of the recess H1. Assuming that a distribution of mass of the imaginary object having the same shape as that of the recess H1 is uniform, it is possible to consider that the center of gravity of the imaginary object is the imaginary center of gravity G1 of the recess H1. Likewise, it is possible to consider that the imaginary center of gravity of the recess H2 is G2. As illustrated in FIG. 2C, the imaginary center of gravity G1 is substantially aligned with the node N near the one end 11, and the imaginary center of gravity G2 is substantially aligned with the node N near the other end 12.

The musical bar 10 is formed in one piece and formed of a material such as wood or alloy. The musical bar 10 is manufactured, for example, by cutting and/or grinding an elongated member, which is formed of a single material and having a rectangular shape in cross section, to remove the area 23 from the back surface of the musical bar 10, i.e., the lower surface of the musical bar 10 in FIG. 2B. As a result, the belly portion 19 is formed. In the case where the musical bar 10 is formed of wood, a direction of wood grain preferably coincides with the longitudinal direction of the musical bar 10. The insertion holes 17, 18 may be formed by drilling, for example. The recess H may be formed by countersinking using an end mill, for example.

Figure 3B:
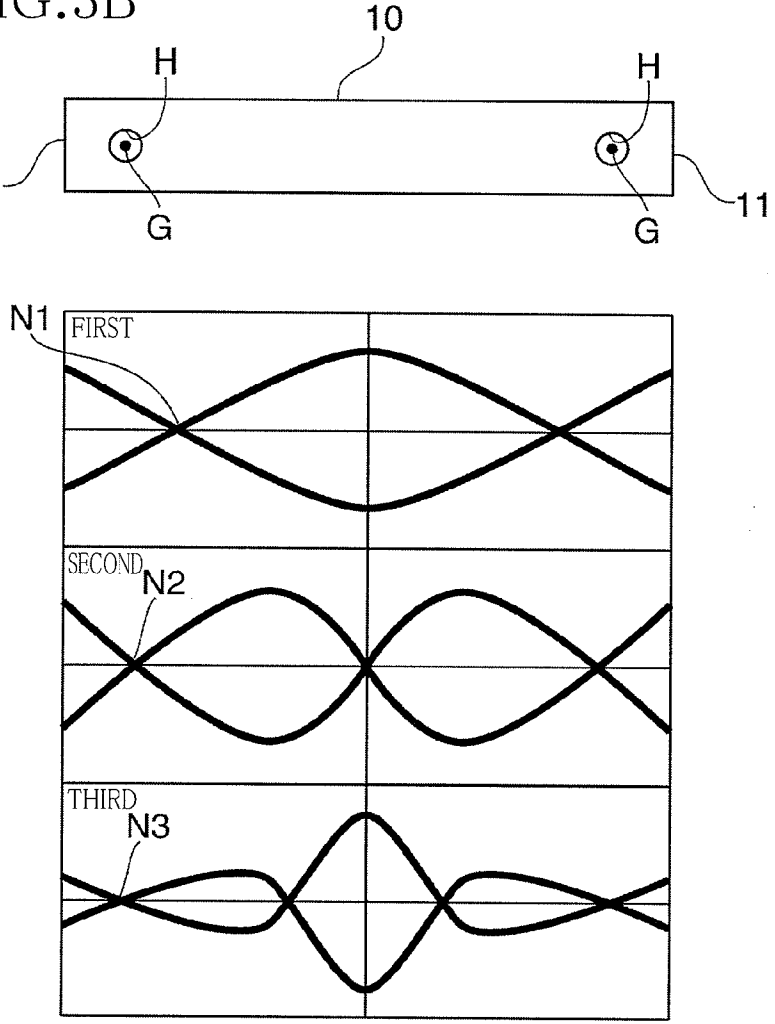
FIG. 3B is a comparative example of waveforms.
Figure 3A:
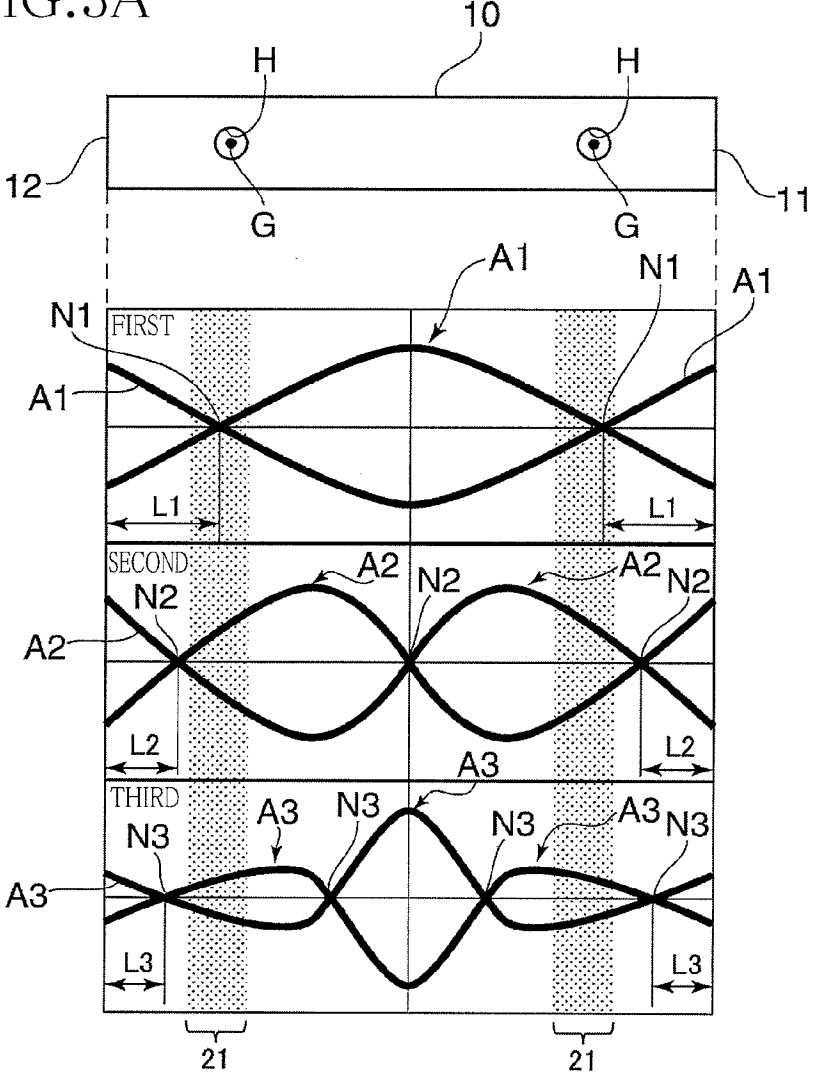
FIG. 3A is a schematic view illustrating waveforms of standing waves in vibrating modes of the musical bar in the case where each node and an imaginary center of gravity of the corresponding recess are aligned with each other.

FIG. 3A is a schematic view illustrating waveforms of standing waves in vibrating modes of the musical bar 10 in the case where each node N and the imaginary center of gravity G of the corresponding recess H are aligned with each other. FIG. 3B is a schematic view as a comparative example illustrating waveforms of standing waves in vibrating modes of the musical bar 10 in the case where the imaginary center of gravity G of each recess H is located nearer to the corresponding one of the ends 11, 12 than the node N. FIGS. 3A and 3B illustrate the musical bar 10 and waveforms in first, second, and third vibrating modes in order from above.

In vibration of the musical bar 10, loops of all the vibrating modes are generally located at open ends, i.e., the one end 11 and the other end 12. In other words, the nodes N are not located at the open ends. Vibration in the first vibrating mode is also vibration of the fundamental tone. The fundamental tone is a tone with a fundamental pitch. When struck and vibrated, the musical bar 10 produces a musical tone with the pitch of the fundamental tone as the unique pitch of the musical bar 10. Vibration of the musical bar 10 includes not only the vibration of the fundamental tone but also vibration of overtones which contains narrower waves. The overtones are produced simultaneously with the fundamental tone. The frequencies of the overtones are integer multiples of the frequency of the fundamental tone. The overtones are produced simultaneously and serve as elements which create tone color. Accordingly, the amplitudes of the overtones greatly affect the tone color.

Marimbas are tuned such that the fourth overtone is produced in the second vibrating mode subsequent to the first vibrating mode, and the tenth overtone is produced in the third vibrating mode subsequent to the second vibrating mode. The fourth overtone and the tenth overtone are respectively four times and ten times the frequency of the fundamental tone. The frequencies in FIGS. 3A and 3B are illustrated in the case of marimbas.

As illustrated in FIG. 3A, the nodes N1 are spaced apart from the one end 11 and the other end 12 at the distance L1 in the first vibrating mode. The nodes N2 are spaced apart from the one end 11 and the other end 12 at the distance L2 in the second vibrating mode. The nodes N3 are spaced apart from the one end 11 and the other end 12 at the distance L3 in the third vibrating mode. Loops A (A1, A2, A3) are formed directly between the nodes N of the musical bar 10 in the longitudinal direction and between each open end of the musical bar 10 and the node N adjacent thereto. It is known that the distance L1 corresponds to the distance L (see FIG. 2C) at the fundamental pitch and is approximately 22.4% of the entire length of the musical bar 10. The distance L2 in the second vibrating mode is approximately 13.2% of the entire length of the musical bar 10. The distance L3 in the third vibrating mode is approximately 9.4% of the entire length of the musical bar 10. It is noted that the positions of the nodes N2, N3 may depend upon the shape (thickness) of the belly portion 19.

The musical bar 10 has the recesses H, resulting in the mass of the musical bar 10 being reduced by an amount corresponding to the volume of the recesses H. The imaginary center of gravity G of each recess H and the corresponding node N of the vibration of the fundamental tone are substantially aligned with each other in the longitudinal direction of the musical bar 10 (see FIG. 3A). In the first vibrating mode, accordingly, even in the case where the mass is reduced near the nodes N1 that never vibrate, the frequency does not change, but the logarithmic decrement lowers in some degree, which makes it easy to the musical bar 10 to produce tones. In the second vibrating mode, the imaginary center of gravity G is not aligned with the node N2 in the longitudinal direction of the musical bar 10, and the recess H is located in an area including a relatively large portion of the loop A2. Thus, even in the case where the mass is reduced by the amount corresponding to the volume of the recesses H, the frequency in the second vibrating mode little changes, but the logarithmic decrement lowers slightly. In the third vibrating mode, the imaginary center of gravity G is located farther from the node N3 than in the third vibrating mode. The recess H is located in an area including a relatively large portion of the loop A3. Since the mass is reduced by the amount corresponding to the volume of the recesses H, the frequency in the third vibrating mode lowers, and the logarithmic decrement lowers in some degree.

Thus, the lowered logarithmic decrement makes it easy for the musical bar 10 to produce the fundamental tone and the tenth overtone. Also, the logarithmic decrement of the fourth overtone does not change greatly. Accordingly, the tone color changes relatively. The change in tone color also depends upon the position of the imaginary center of gravity G and the volume of the recesses H.

The musical bar 10 according to the present embodiment and the comparative example illustrated in FIG. 3B will be compared. In the comparative example in FIG. 3B, each of the recesses H (the imaginary center of gravity G) is positioned on an outer side than in the musical bar 10 according to the present embodiment in the longitudinal direction. That is, each of the recesses H is nearer to the corresponding one of the one end 11 and the other end 12 in the comparative example than in the present embodiment. In this construction, in the first vibrating mode, the imaginary center of gravity G is not aligned with the node N1, and the recess H is located in an area including a relatively large portion of the loop A1. Thus, the amplitude of the fundamental tone is reduced, which makes it difficult to produce the tone with the fundamental pitch. It is noted that the recess H is located near the nodes N2 in the second vibrating mode and is located so as to contain the node N3 in the third vibrating mode in the comparative example. Thus, the amplitudes of the fourth overtone and the tenth overtone are less reduced in the comparative example than in the present embodiment. Accordingly, reduction in volume of the fundamental tone is undesirably greater than effects on change in tone color.

In view of the above, the imaginary center of gravity G of each recess H and the corresponding node N1 of vibration in the first vibrating mode (the fundamental tone) are preferably aligned substantially with each other in the longitudinal direction of the musical bar 10 to easily adjust tone color without greatly affecting the unique pitch. In other words, it is preferable that the imaginary center of gravity G of the recess H is aligned with the node N1 in the first vibrating mode as much as possible, and the recess H is formed in an area not containing the position of the nodes N2 in the second vibrating mode or the position of the nodes N3 in the third vibrating mode.

This condition is satisfied when the recesses H are respectively formed in areas 21 in the longitudinal direction in the case of the construction illustrated in FIG. 3A, for example. That is, each recess H is preferably formed such that the imaginary center of gravity G is located within the area 21 from the viewpoint of effectively changing the tone color without greatly affecting the fundamental tone. The length of the area 21 is 15 to 25% of the entire length of the musical bar 10. In the case where the recess H has a round shape when viewed from below, the recess H preferably has the diameter of approximately 3 to 4% of the entire length of the musical bar 10 and the thickness of approximately 20 to 25% of that of the musical bar 10.

It is noted that the positions of the respective nodes N1 are not always determined accurately, and accordingly even when the imaginary center of gravity G and the node N1 are misaligned slightly, the recess H is preferably formed within an area including the node N1. When the imaginary center of gravity G and the node N1 are substantially aligned with each other at the very least, the tone color is changed effectively in some degree even in the case where the area in which the recess H is formed includes any of the node N2 or the node N3. The same effects occur also in the fourth and subsequent vibrating modes. Thus, the musical bar 10 is preferably constructed in consideration of a relationship between the area in which the recess H is formed and the nodes in the fourth and subsequent vibrating modes, but the relationship affects the tone color in smaller degree in the fourth and subsequent vibrating modes than in the second and third vibrating modes.

In the case where the musical bar 10 is employed for marimbas and vibraphones, in particular, each recess H is preferably formed in an area not including the nodes N2 of vibration of the fourth overtone or the nodes N3 of vibration of the tenth overtone, in the longitudinal direction of the musical bar 10. In the case where the recesses H are formed in this manner, the logarithmic decrements of the fundamental tone and the tenth overtone can be lowered effectively to change overall tone color appropriately for marimbas, for example.

It is noted that in the case where the musical bar 10 is employed for xylophones, the musical bar 10 is tuned such that the third overtone and the seventh overtone are to be produced in the respective second and third vibrating modes. In this case, accordingly, each recess H is preferably formed in an area not including the nodes of vibration of the third overtone and the seventh overtone, in the longitudinal direction of the musical bar 10. In the case where the recesses H are formed in this manner, the logarithmic decrements of the fundamental tone and the seventh overtone can be lowered effectively to change overall tone color appropriately for xylophones, for example. It is noted that the positions of the respective nodes of vibration of the third overtone and the seventh overtone differ from the respective nodes of vibration of the fourth overtone and the tenth overtone.

In the musical bar 10 according to the present embodiment, the imaginary center of gravity G of each recess H and the corresponding node N1 of vibration in the first vibrating mode (the fundamental tone) are substantially aligned with each other in the longitudinal direction of the musical bar 10. This construction enables easy adjustment of tone color without greatly affecting the unique pitch and can reduce the overall logarithmic decrement. Also, each recess H is formed in the area not including the nodes N2 or the nodes N3. Thus, the logarithmic decrements of the first and third vibrating modes to change the overall tone color.

The recesses H communicate with the respective insertion holes 17, 18. This construction allows the user to view the insertion holes 17, 18 from the respective recesses H, facilitating maintenance of the musical bar 10. Also, the recess H is a blind hole formed in the back surface 14, thereby not affecting the appearance of the musical bar 10 or a striking area.

It is noted that in the case where visual recognition of the insertion holes 17, 18 is not required, the recesses H need not be formed to such a depth that the recesses H communicate with the respective insertion holes 17, 18. In the case where the effects on the appearance of the musical bar 10 and the striking area are not taken into consideration, the recess H may extend to the striking surface 13.

While the recess H has the circular cylindrical shape in the above-described embodiment, the shape of the recess H is not limited. Also, the number of the recesses H is not limited. FIGS. 4A-4G illustrate various kinds of modifications of the recess H.

Figure 4A:
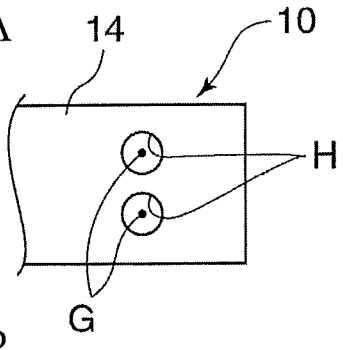
FIGS. 4A-4G are schematic views of recesses according to modifications.
Figure 4B:
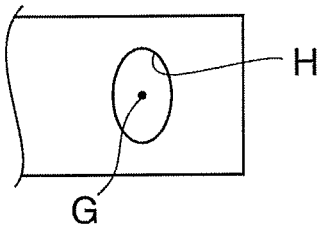
Figure 4C:
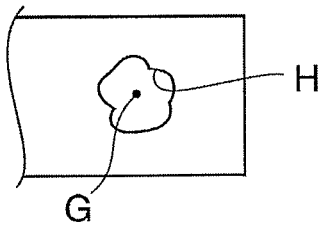
Figure 4D:
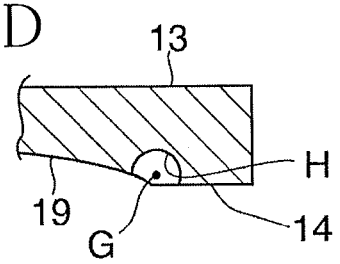
Figure 4E:
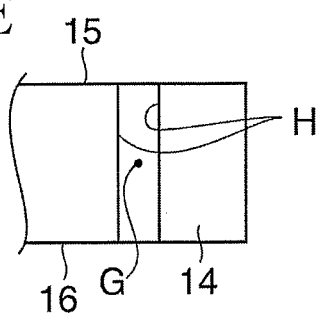

FIGS. 4A-4G are schematic views each illustrating a modification of the recess H. For example, in FIG. 4A, two recesses H are formed at the same position in the longitudinal direction, and the imaginary center of gravity G of each of the two recesses H is substantially aligned with the node N1. In other modifications, as illustrated in FIGS. 4B and 4C, the recess H may have an oval shape or a special shape when viewed from below. In another modification, as illustrated in the cross-sectional view in FIG. 4D and the bottom view in FIG. 4E, the recess H may be formed in the back surface 14 as a groove extending in the widthwise direction of the musical bar 10.

Figure 4F:
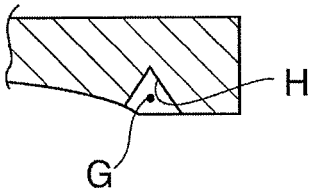
Figure 4G:
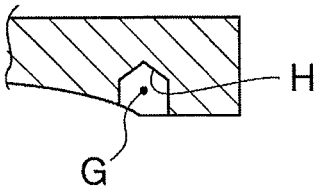

The shapes of the recess H in horizontal cross section and vertical cross section are not limited. For example, as illustrated in FIG. 4F, the recess H may be shaped like a cone having a point at its upper end. Also, as illustrated in FIG. 4G, the recess H may have a round shape in cross section from the bottom of the musical bar 10 to a midway portion thereof and have a cone shape from the midway portion to the top of the musical bar 10. The recesses H in these modifications are easily formed by drilling.

In the case where the centroid of the recess H in horizontal cross section is located at the same position at any horizontal cross section, that is, in the case where the recess H is shaped like a circular cylinder or a cone, for example, each recess H may be formed such that the centroid of the recess H and the node N are substantially aligned with each other when below from bottom, instead of the construction in which the imaginary center of gravity G of the recess H and the node N are aligned with each other.

While the embodiment has been described above, it is to be understood that the disclosure is not limited to the details of the illustrated embodiment, but may be embodied with various changes and modifications, which may occur to those skilled in the art, without departing from the spirit and scope of the disclosure.

What is claimed is:

1. A musical bar for a musical instrument, the musical bar comprising:

a striking surface; and a back surface which is a back side of the musical bar from the striking surface, wherein when the striking surface is struck, the musical bar is vibrated to produce a musical tone with a unique pitch as a pitch of a fundamental tone, wherein an insertion hole is formed in the musical bar so as to extend substantially in a widthwise direction thereof, and a supporter via which the musical bar is supported by the musical instrument is inserted in the insertion hole, and wherein, in addition to the insertion hole, a recess is formed, in the longitudinal direction, in an area including a node of vibration of the fundamental tone.

2. The musical bar according to claim 1, wherein an imaginary center of gravity of the recess is substantially aligned with a position of a node in a first vibrating mode in the longitudinal direction, and wherein the recess is formed in an area not including a position of a node in a second vibrating mode or a position of a node in a third vibrating mode in the longitudinal direction.

3. The musical bar according to claim 1, wherein the recess is formed in an area not including a position of a node of vibration of a fourth overtone or a position of a node of vibration of a tenth overtone in the longitudinal direction.

4. The musical bar according to claim 1, wherein the recess is formed in an area not including a position of a node of vibration of a third overtone or a position of a node of vibration of a seventh overtone in the longitudinal direction.

5. The musical bar according to claim 1, wherein the recess communicates with the insertion hole.

* * * * *